United States Patent [19]

Ripamonti

[11] Patent Number: 4,957,784

[45] Date of Patent: Sep. 18, 1990

[54] MANUFACTURED ARTICLE FOR INSTANTANEOUSLY MAKING DECORATIVE BOWS AND THE LIKE

[75] Inventor: Ruggero Ripamonti, Osnago, Italy

[73] Assignee: Nastrificio Lombardo S.R.L., Milan, Italy

[21] Appl. No.: 359,990

[22] Filed: May 31, 1989

[30] Foreign Application Priority Data

Feb. 28, 1989 [IT] Italy ..... 20647/89[U]

[51] Int. Cl.[5] ..... D04D 7/10

[52] U.S. Cl. ..... 428/5; 28/145; 139/385; 428/115

[58] Field of Search ..... 28/145; 139/385; 428/115, 4, 5, 26

[56] References Cited

U.S. PATENT DOCUMENTS 2,102,934 12/1937 Arnold ..... 428/115 X 2,316,350 4/1943 Mehler ..... 428/115

FOREIGN PATENT DOCUMENTS 1191547 5/1970 United Kingdom ..... 428/115

*Primary Examiner*—Henry F. Epstein

*Attorney, Agent, or Firm*—Laff, Whitesel, Conte & Saret

[57] ABSTRACT

A manufactured article comprising a decorative band 3 formed with a ribbon-like element 4 folded back so as to form a plurality of loops 4a consecutively disposed in side by side relationship and connected to a flexible support ribbon 2 by at least a stitching 5 fixedly engaging each of said loops in the region of their ends and extending all around the section of the flexible support ribbon 2 so that it can slide along the ribbon.

2 Claims, 2 Drawing Sheets

MANUFACTURED ARTICLE FOR INSTANTANEOUSLY MAKING DECORATIVE BOWS AND THE LIKE

BACKGROUND OF THE INVENTION

1. Field of the Invention

The present invention relates to a manufactured article for instantaneously making decorative bows and the like, of the type comprising a flexible support and a decorative flexible band having a longitudinal edge slidably engaged along the flexible support. In greater detail, the manufactured article in question lends itself to the accomplishment of bows of the type currently used to decorate packed presents and the like.

2. Prior Art

It is known that manufactured articles of the above type have already been produced and marketed and they substantially comprise a flexible support generally consisting of a mere cord which is enclosed by stitching in the edge of a flexible band, usually made of fabric, so that the band edge can slide along the cord. Originally the manufactured article is in the form of a continuous strip wound on a reel. A piece of suitable length is cut every time, as needed, from said strip and a decorative bow can be accomplished therefrom. In greater detail, in order to make a bow from the piece of manufactured article cut away, it is sufficient to make the fabric band slide along the cord and dispose the opposite ends of the band upon each other so that the band is bent over upon itself and thus the desired bow is ready. At the end of the operation the cord lengths projecting from the opposite ends of the band are used to tie the bow to the article to which it is to be applied.

Although the manufactured articles of the above type appear very practical in use, they have however some drawbacks as regards both production costs and the final aesthetic effect which can be reached.

Actually a band made of textile material has rather high prices and in addition, due to said material, it is rather difficult to give a particularly homogeneous and uniform configuration to the bow thus formed.

Furthermore the aesthetic features of the cord used to tie the bow and engaged therewith are not so high as to match with those of the bow itself and of a packed present in general.

SUMMARY OF THE INVENTION

The main object of the present invention is substantially to eliminate the above drawbacks by providing a manufactured article having low production costs while offering a product of improved quality from an aesthetic point of view.

The foregoing and further objects which will become more apparent from the following description are substantially attained by a manufactured article for instantaneously making decorative bows and the like, wherein said decorative band comprises at least a ribbon-like element folded back so as to form a plurality of loops consecutively disposed in side by side relationship, said ribbon-like element being connected to the flexible support by at least a stitching made all around the section of the flexible support itself and engaging each of said loops in the region of their ends.

BRIEF DESCRIPTION OF THE DRAWINGS

Further features and advantages of the invention will best be understood from the detailed description of a preferred embodiment of a manufactured article for instantaneously making decorative bows and the like according to the present invention, given hereinafter by way of non-limiting example with reference to the accompanying drawings, in which.

DESCRIPTION OF THE PREFERRED EMBODIMENT

Figure 2:
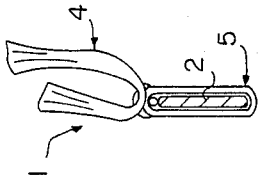
FIG. 2 is a sectional view of the manufactured article taken along line II—II in FIG. 1.
Figure 1:
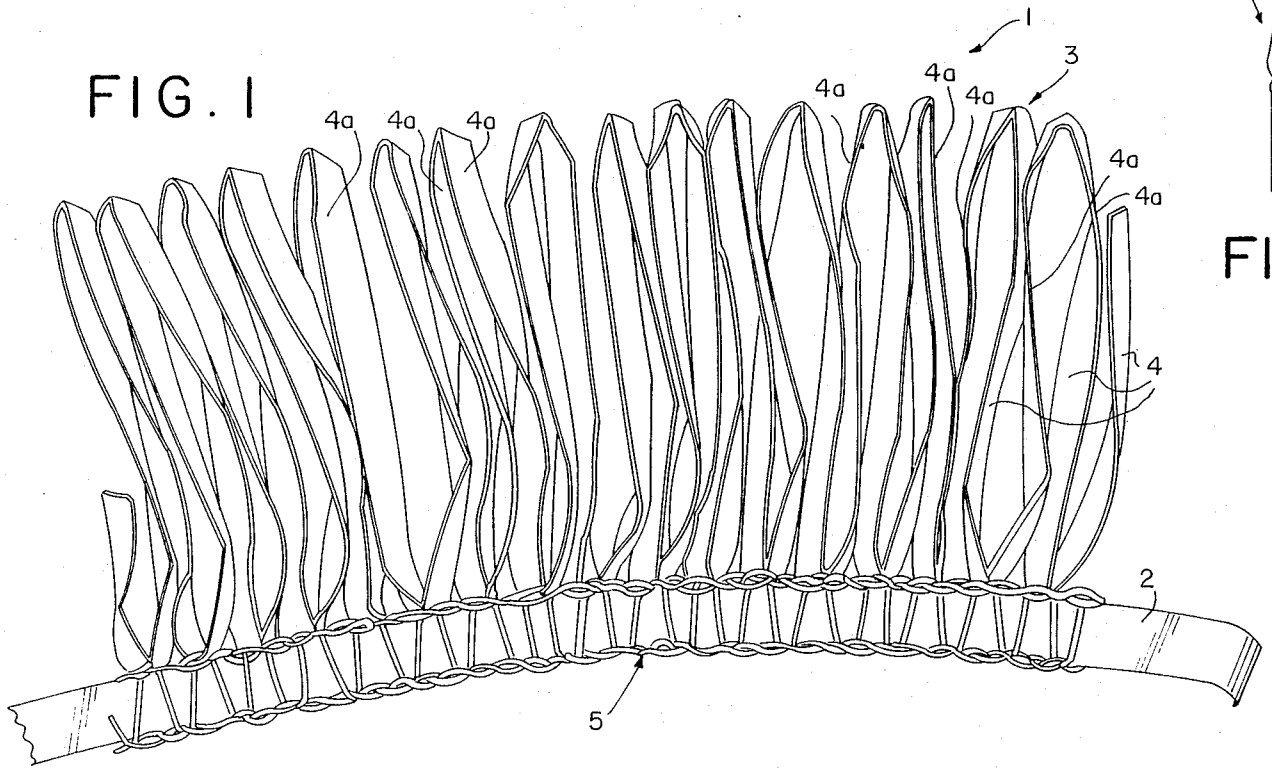
FIG. 1 is a side fragmentary view to an enlarged scale of a piece of the manufactured article of the invention.

Referring to the drawings and in particular to FIGS. 1 and 2, a manufactured article for instantaneously making decorative bows and the like according to the present invention has been generally identified by reference numeral 1. In known manner, the manufactured article 1 substantially comprises a flexible support 2 and a decorative band 3 which is flexible too and has a longitudinal edge slidably engaged along the flexible support 2.

The flexible support 2 preferably consists of at least a support ribbon. In turn, the decorative band 3 comprises at least a ribbon-like element, identified at 4, folded back so as to form a plurality of loops **4*a* consecutively disposed in side by side relationship and preferably having the same length in order to give an almost constant width to the decorative band 3** seen as a whole.

Advantageously, the ribbon-like element 4 is connected to the support ribbon 2 by at least a stitching 5 fixedly engaging each of the loops **4*a* in the region of their ends. As clearly shown in FIG. 2, the stitching 5 is made all around the section of the support ribbon 2**, in a manner known per se, so as to be slidably passed through by said support ribbon.

Referring particularly to FIGS. 3 to 7, the mode of use of the manufactured article in question is as follows.

Figure 3:
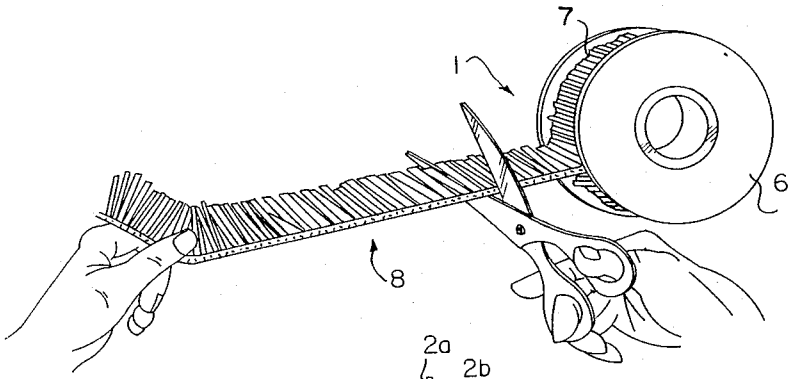
FIG. 3 is a perspective view of the manufactured article wound on a reel, while a portion thereof is being cut away.
Figure 5:
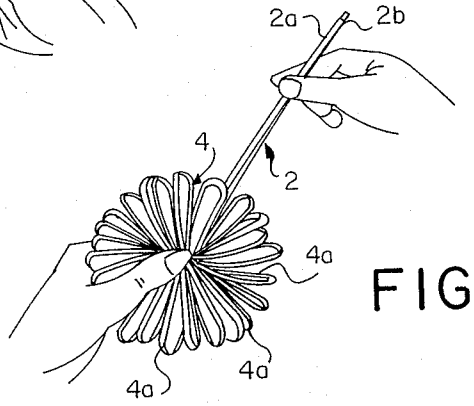
FIG. 5 shows the operation immediately following the one shown in FIG. 4.
Figure 7:
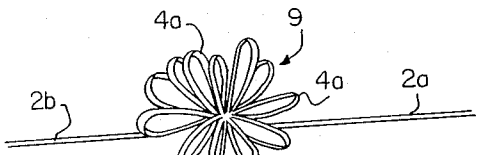
FIG. 7 is a perspective view of the completed bow.
Figure 4:
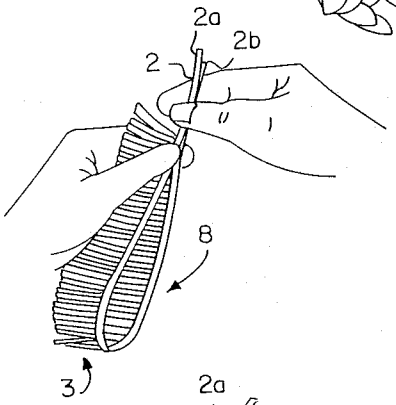
FIG. 4 shows a first operation to be carried out on the cut away portion in order to make a bow.
Figure 6:
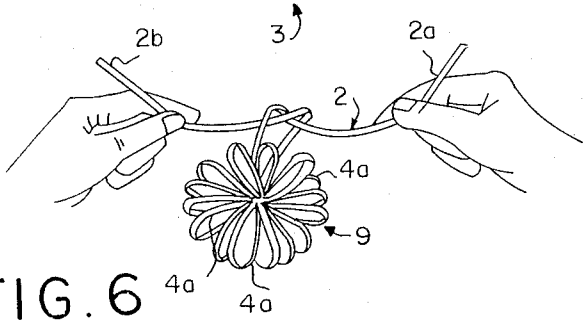
FIG. 6 shows the final operation for the accomplishment of the bow.

As shown in FIG. 3, the manufactured article 1 is originally wound on a reel 6, in the form of a continuous strip 7. A piece 8 of said article is cut in the desired length from the strip 7 and it is used to make a bow 9 (FIGS. 6 and 7). For the accomplishment of bow 9, first the opposite ends of the piece 8 are disposed upon each other, as shown in FIG. 4. Then (see FIG. 5) the ribbon-like element is caused to slide, together with the line of stitching 5 fixedly engaging it, along the support ribbon 2, until the ends of the flexible band 3 cannot slide any longer.

The bow is completed by merely knotting the ends **2*a*, 2*b* of the support ribbon 2 freely projecting from the flexible band 3, as shown in FIG. 6**.

The completed bow 9 will appear as viewed in FIG. 7, that is its loops will be homogeneously distributed according to a substantially spherical configuration and the two portions **2*a*, 2*b* of the support ribbon 2** will freely project from the bow in order to allow the latter to be engaged with the parcel to which it is to be applied.

The present invention attaints the intended purposes.

In fact, the present manufactured article can be produced in a very simple manner, by a single working during which the folding of the ribbon-like element 4 and the stitching 5 connecting the ribbon-like element to the support ribbon 2 are simultaneously carried out. As a result, the production costs are much lower than those of the prior art. In addition, the manufactured article of the invention allows the accomplishment of bows having improved aesthetic qualities as compared with those of the known art. Actually, the completed bow 9 has a uniform configuration and lends itself to be applied to parcels and the like by means of the support ribbon 2, instead of being obliged to use the traditional cord which does not always give satisfactory results from an aesthetic point of view.

The invention as conceived is susceptible of many modifications and variations all falling within the scope of the inventive idea characterizing it.

What is claimed is:

1. A manufactured article for instantaneously making decorative bows and the like, comprising:

a flexible support ribbon;

a decorative flexible band formed by ribbon-like element folded back so as to form a plurality of loops consecutively disposed in side by side relationship;

at least a stitching made all around the support ribbon and engaging each of said loops in the region of their ends, said stitching being slidable along the flexible support ribbon from a condition of maximum extension in which the loops are consecutively disposed side by side, to a condition of minimum extension in which the loops are homogeneously gathered whereby a bow having a substantially spherical configuration is formed.

2. The manufactured article as claimed in claim 1, wherein the loops formed by said folded back ribbon-like element substantially have all the same length.

* * * * *